US011236982B1

(12) United States Patent
Ganguillet

(10) Patent No.: US 11,236,982 B1
(45) Date of Patent: Feb. 1, 2022

(54) HORIZONTAL FIREARM MAGAZINE HOLSTER APPARATUS

(71) Applicant: George Ganguillet, Mason, MI (US)

(72) Inventor: George Ganguillet, Mason, MI (US)

( * ) Notice: Subject to any disclaimer, the term of this patent is extended or adjusted under 35 U.S.C. 154(b) by 0 days.

(21) Appl. No.: 17/098,533

(22) Filed: Nov. 16, 2020

(51) Int. Cl.
*F42B 39/02* (2006.01)
*A45F 5/02* (2006.01)

(52) U.S. Cl.
CPC ..... *F42B 39/02* (2013.01); *A45F 5/021* (2013.01)

(58) Field of Classification Search
CPC ..... F42B 39/02; F42B 39/00; F42B 39/26; A45F 5/02; A45F 5/021; F41C 33/041; F41C 33/048
See application file for complete search history.

(56) References Cited

U.S. PATENT DOCUMENTS 4,799,323 A 1/1989 Musgrave
5,152,442 A * 10/1992 Gallagher ..... A45F 5/02 206/3
5,174,482 A * 12/1992 Rogers ..... F42B 39/02 221/185
6,202,908 B1 3/2001 Groover
7,314,152 B1 * 1/2008 Garrett ..... F41C 33/0236 224/192
2003/0071095 A1 * 4/2003 Dedrick ..... A45F 5/00 224/183
2007/0278269 A1 12/2007 Rogers
2010/0176174 A1 7/2010 Felts
2013/0082080 A1 4/2013 Hellweg
2013/0254976 A1 * 10/2013 Aravena ..... F42B 39/02 2/300
2015/0208796 A1 * 7/2015 Seuk ..... A45F 5/021 224/660
2016/0003578 A1 * 1/2016 Vertreese ..... F41C 33/0209 224/192

* cited by examiner

*Primary Examiner* — Corey N Skurdal

(57) ABSTRACT

A horizontal firearm magazine holster apparatus for easy concealment and comfort includes a backing and a holster body coupled to the backing. The holster body is coupled adjacent a backing left edge, a backing right edge, and a backing bottom edge and has an open holster top side to define a holster cavity. The holster cavity receives a firearm magazine. A pair of bases is coupled to the holster body with each base coupled to a backing back side. A pair of clips is coupled to the pair of bases. Each clip has a stem rotatably coupled to the respective base and a U-shaped arm coupled to the stem. The U-shaped arm is configured to selectively engage a belt or a waistline of a pant to orient the backing horizontally with the backing left edge or the backing right edge facing upwards.

7 Claims, 4 Drawing Sheets

HORIZONTAL FIREARM MAGAZINE HOLSTER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to firearm magazine devices and more particularly pertains to a new firearm magazine device for easy concealment and comfort. The present invention includes rotational clips to allow a firearm magazine to be held horizontally or vertically when worn.

(2) Description of Related Art Including Information Disclosed Under 37 CFR 1.97 and 1.98

The prior art relates to firearm magazine devices. Known devices secure the firearm magazine in a vertical position on the user's belt and are thus difficult to conceal and potentially uncomfortable to wear. These devices lack rotational clips and often include a strap, cover, or physical mechanism rather than magnets to restrict the accidental withdrawal of the magazine.

BRIEF SUMMARY OF THE INVENTION

An embodiment of the disclosure meets the needs presented above by generally comprising a backing having a backing front side, a backing back side, a backing left edge, a backing right edge, a backing top edge, and a backing bottom edge. A holster body is coupled to the backing. The holster body is coupled adjacent the backing left edge, the backing right edge, and the backing bottom edge and has an open holster top side to define a holster cavity. The holster cavity is configured to receive a firearm magazine. A pair of bases is coupled to the holster body with each base coupled to the backing back side. A pair of clips is coupled to the pair of bases. Each clip has a stem rotatably coupled to the respective base and a U-shaped arm coupled to the stem. The U-shaped arm is configured to selectively engage a belt or a waistline of a pant to orient the backing horizontally with the backing left edge or the backing right edge facing upwards.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
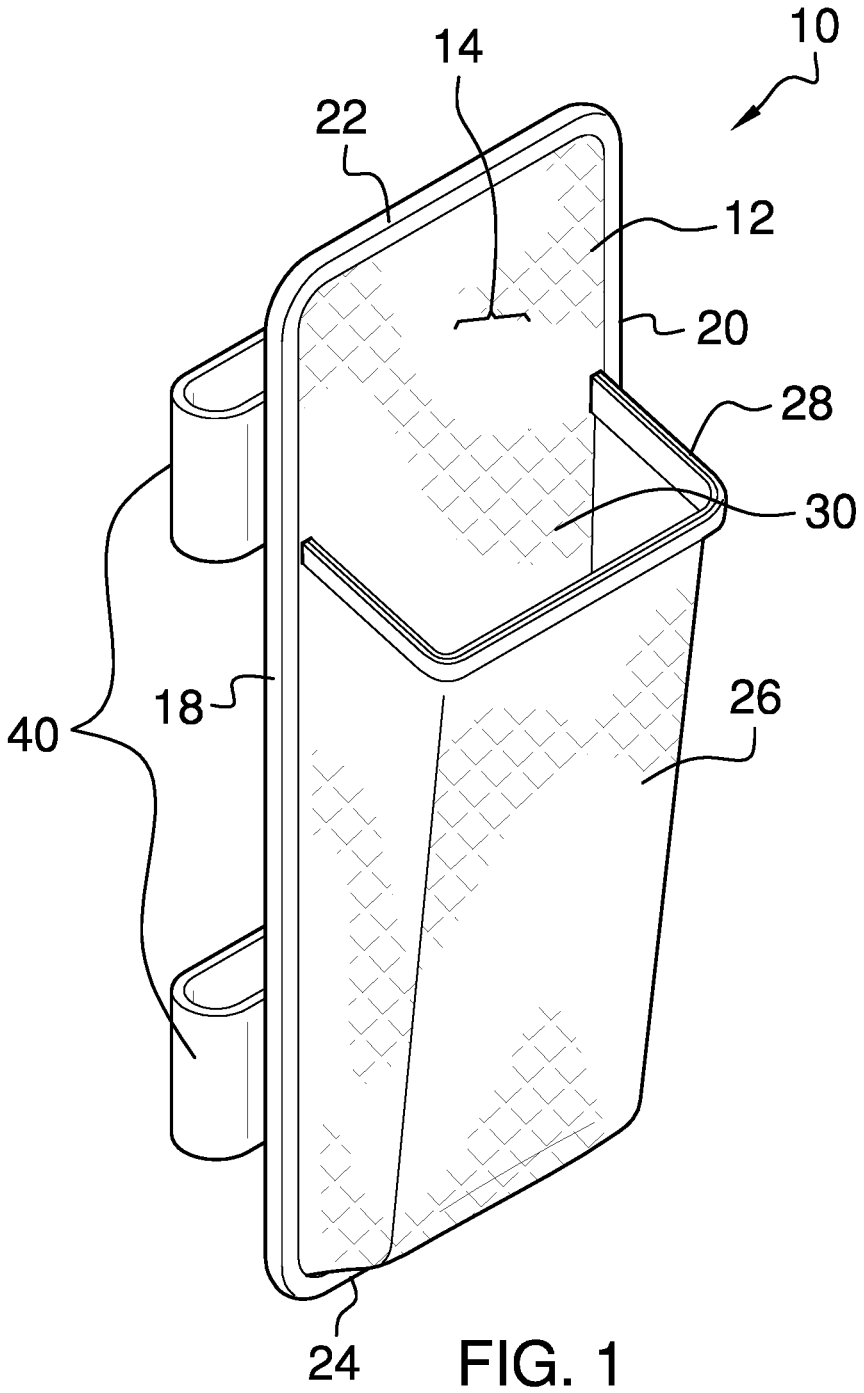
FIG. 1 is an isometric view of a horizontal firearm magazine holster apparatus according to an embodiment of the disclosure.
Figure 2:
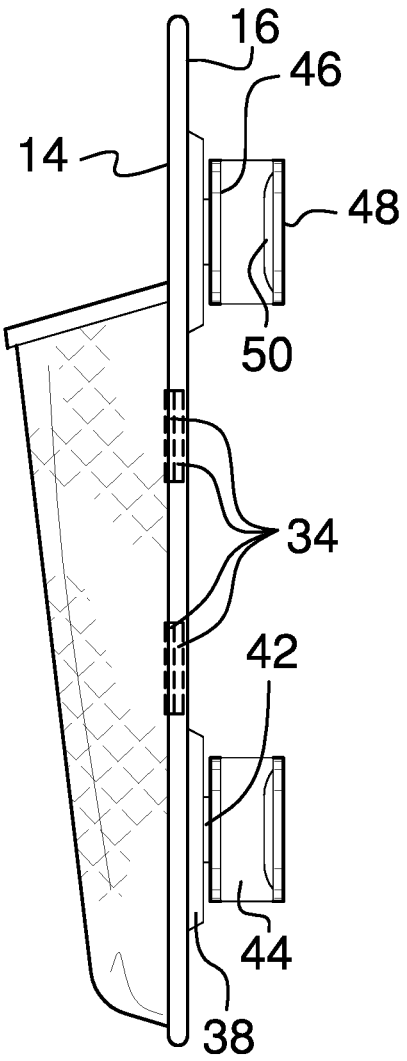
FIG. 2 is a side elevation view of an embodiment of the disclosure.
Figure 3:
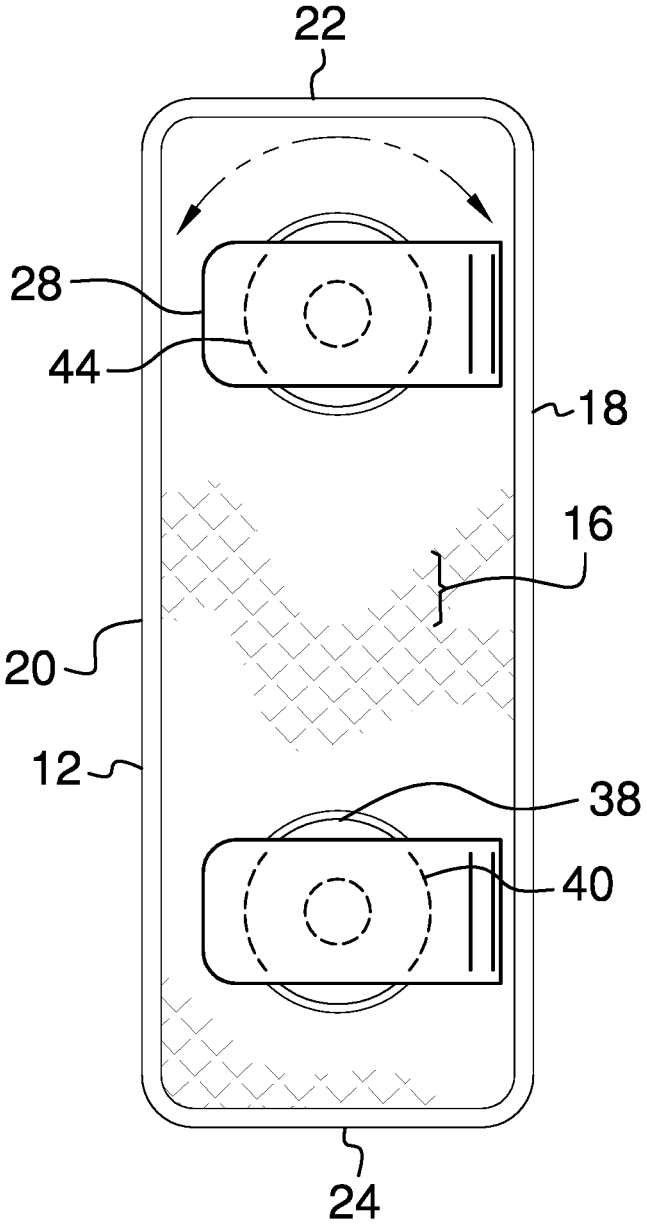
FIG. 3 is a rear elevation view of an embodiment of the disclosure.
Figure 4:
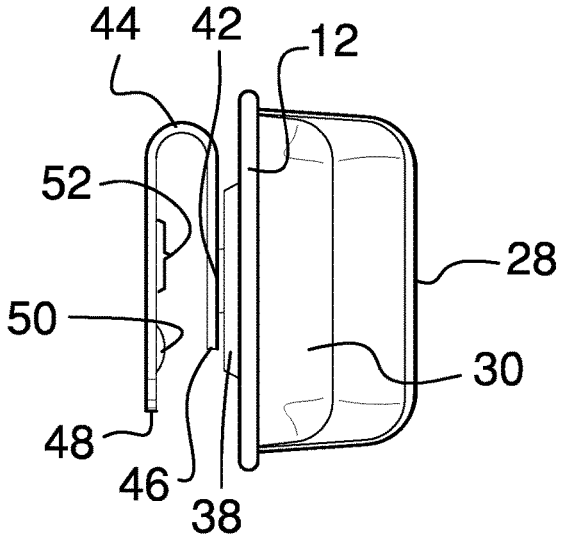
FIG. 4 is a bottom plan view of an embodiment of the disclosure.
Figure 5:
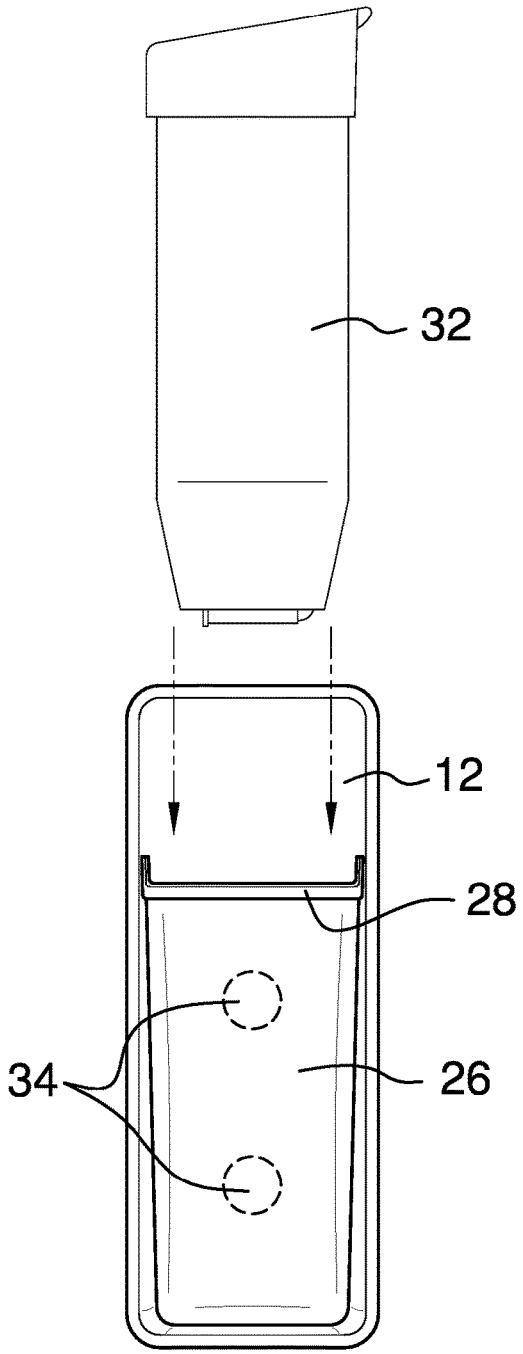
FIG. 5 is a front elevation in-use view of an embodiment of the disclosure.
Figure 6:
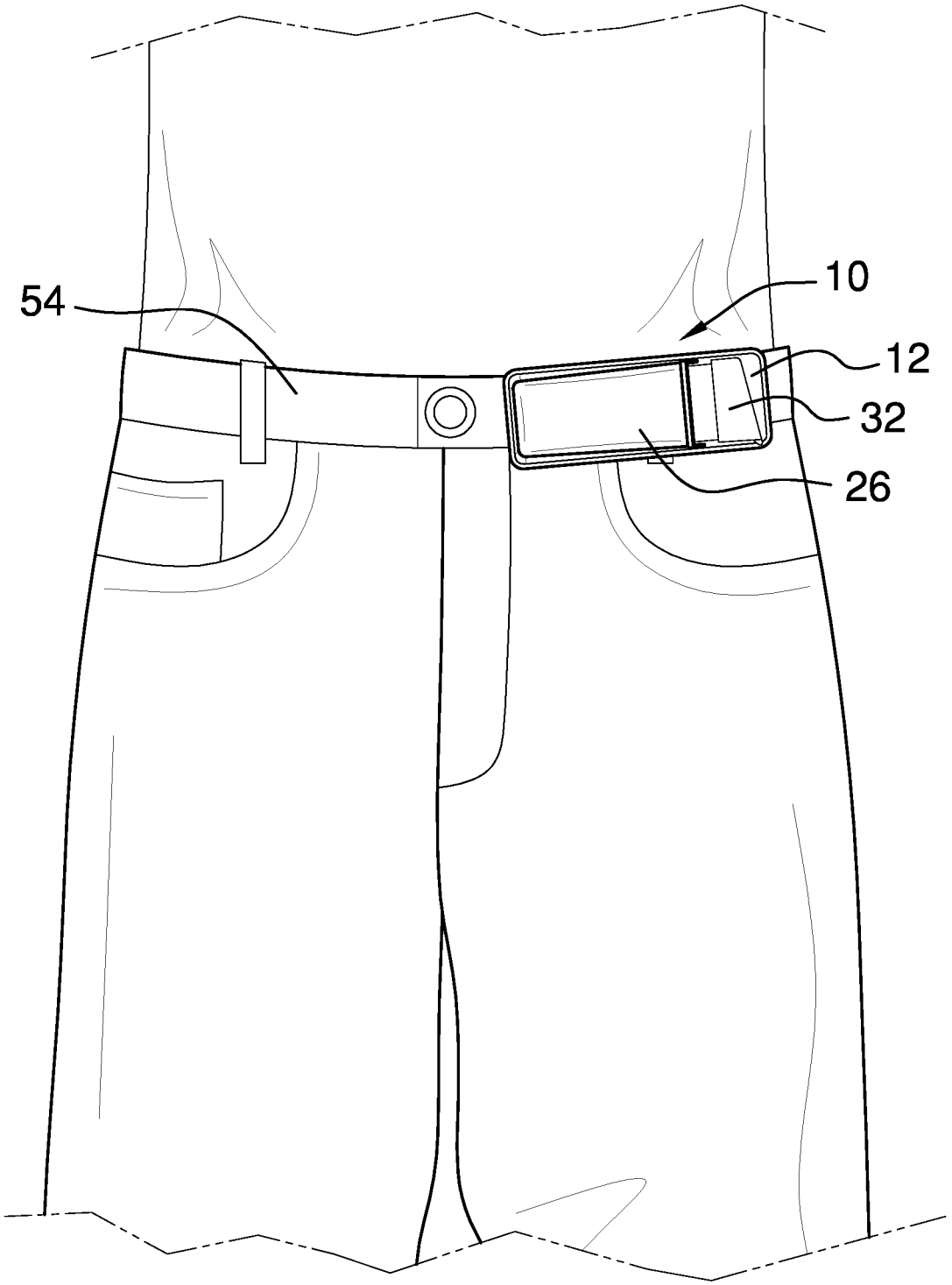
FIG. 6 is an in-use view of an embodiment of the disclosure.

With reference now to the drawings, and in particular to FIGS. 1 through 6 thereof, a new firearm magazine device embodying the principles and concepts of an embodiment of the disclosure and generally designated by the reference numeral 10 will be described.

As best illustrated in FIGS. 1 through 6, the horizontal firearm magazine holster apparatus 10 generally comprises a backing 12 having a backing front side 14, a backing back side 16, a backing left edge 18, a backing right edge 20, a backing top edge 22, and a backing bottom edge 24. The backing 12 may be rectangular with rounded corners to minimize size and interference with clothing.

A holster body 26 is coupled to the backing 12. The holster body 26 is coupled adjacent the backing left edge 18, the backing right edge 20, and the backing bottom edge 24 and has an open holster top side 28 to define a holster cavity 30 with the backing front side 14. The holster body 26 may taper closer to the backing front side 14 from the open holster top side 28 to the backing bottom edge 24. The open holster top side 28 may form an angle with the backing front side 14 between 60° and 90°. The holster cavity 30 is configured to receive a firearm magazine 32. The angle of the open holster top side 28 may allow for easier access to the firearm magazine 32. The taper of the holster body 26 may function to further secure the firearm magazine 32.

A plurality of magnets 34 is coupled to the backing 12. The plurality of magnets 34 is configured to selectively engage the firearm magazine 32 and prevent accidental removal from the holster cavity 30. The plurality of magnets 34 may be arranged in a pair of magnet stacks 36 to maximize the strength of the attraction to the firearm magazine 32. The plurality of magnets 34 may be embedded within the backing 12 between the backing front side 14 and the backing back side 16.

A pair of bases 38 is coupled to the holster body 12. Each base 38 is coupled to the backing back side 16. Each base 38 may be circular to accommodate rotation. A pair of clips 40 is coupled to the pair of bases 38. Each clip 40 has a stem 42 rotatably coupled to the respective base 38 and a U-shaped arm 44 coupled to the stem 42. The arm 44 of each clip has a proximal edge 46 and a distal edge 48. The stem 42 is coupled to the arm 44 proximal the proximal edge 46. The distal edge 48 may extend beyond the proximal edge 46 to allow for easier manipulation to open the arm 44 for engagement. The arm 44 of each clip may have an engagement protrusion 50 extending from an arm inner face 52 proximal the distal edge 48 to prevent accidental disengagement. Each arm 44 is configured to selectively engage a belt 54 or a waistline of a pant to orient the backing 12 horizontally with the backing left edge 18 or the backing right edge 20 facing upwards. Each arm 44 may be elastically deformable to squeeze the belt 54 or waistline.

In use, the pair of clips 40 is rotated to the desired orientation and attached to the user's belt 54 or waistline. The firearm magazine 32 is inserted within the holster cavity 30 to be stored in a comfortable, discrete position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A horizontal firearm magazine holster apparatus comprising:

a backing having a backing front side, a backing back side, a backing left edge, a backing right edge, a backing top edge, and a backing bottom edge;

a holster body coupled to the backing, the holster body being coupled adjacent the backing left edge, the backing right edge, and the backing bottom edge and having an open holster top side to define a holster cavity, the holster cavity being configured to receive a firearm magazine;

a pair of bases coupled to the holster body, each base being coupled to the backing back side;

a pair of clips coupled to the pair of bases, each clip having a stem rotatably coupled to the respective base and a U-shaped arm coupled to the stem, the U-shaped arm being configured to selectively engage a belt or a waistline of a pant to orient the backing horizontally with the backing left edge or the backing right edge facing upwards; and a plurality of magnets coupled to the backing, the plurality of magnets being configured to selectively engage the firearm magazine and prevent accidental removal from the holster cavity.

2. The horizontal firearm magazine holster apparatus of claim 1 further comprising the plurality of magnets being arranged in a pair of magnet stacks.

3. The horizontal firearm magazine holster apparatus of claim 1 further comprising the open holster top side forming an angle with the backing front side between 60° and 90°.

4. The horizontal firearm magazine holster apparatus of claim 1 further comprising the holster body tapering closer to the backing front side from the open holster top side to the backing bottom edge.

5. The horizontal firearm magazine holster apparatus of claim 1 further comprising the arm of each clip having a proximal edge and a distal edge, the stem being coupled to the arm proximal the proximal edge, the distal edge extending beyond the proximal edge.

6. The horizontal firearm magazine holster apparatus of claim 5 further comprising the arm of each clip having an engagement protrusion extending from an arm inner face proximal the distal edge.

7. A horizontal firearm magazine holster apparatus comprising:

a backing having a backing front side, a backing back side, a backing left edge, a backing right edge, a backing top edge, and a backing bottom edge;

a holster body coupled to the backing, the holster body being coupled adjacent the backing left edge, the backing right edge, and the backing bottom edge and having an open holster top side to define a holster cavity, the holster body tapering closer to the backing front side from the open holster top side to the backing bottom edge, the open holster top side forming an angle with the backing front side between 60° and 90°, the holster cavity being configured to receive a firearm magazine;

a plurality of magnets coupled to the backing, the plurality of magnets being configured to selectively engage the firearm magazine and prevent accidental removal from the holster cavity, the plurality of magnets being arranged in a pair of magnet stacks;

a pair of bases coupled to the holster body, each base being coupled to the backing back side; and a pair of clips coupled to the pair of bases, each clip having a stem rotatably coupled to the respective base and a U-shaped arm coupled to the stem, the arm of each clip having a proximal edge and a distal edge, the stem being coupled to the arm proximal the proximal edge, the distal edge extending beyond the proximal edge, the arm of each clip having an engagement protrusion extending from an arm inner face proximal the distal edge, the U-shaped arm being configured to selectively engage a belt or a waistline of a pant to orient the backing horizontally with the backing left edge or the backing right edge facing upwards.

* * * * *